US005613997A

United States Patent [19]

Satchell, Jr.

[11] Patent Number: 5,613,997

[45] Date of Patent: Mar. 25, 1997

[54] METALLURGICAL PROCESS

[75] Inventor: Donald P. Satchell, Jr., Summit, N.J.

[73] Assignee: The BOC Group plc, Windlesham, England

[21] Appl. No.: 530,685

[22] Filed: Sep. 18, 1995

Related U.S. Application Data

[63] Continuation-in-part of Ser. No. 214,900, Mar. 17, 1994, abandoned.

[51] Int. Cl.[6] ..... C22B 5/14

[52] U.S. Cl. ..... 75/414; 75/446; 75/958

[58] Field of Search ..... 266/160; 75/500, 75/501, 502, 707, 414, 446, 958

[56] References Cited

U.S. PATENT DOCUMENTS

| | | | |
|---|---|---|---|
| 4,260,412 | 7/1981 | Summers et al. . | |
| 4,678,508 | 7/1987 | Saeki et al. | 266/172 |
| 4,851,040 | 7/1989 | Hoster et al. | 266/160 |
| 4,995,904 | 2/1991 | Hauk | 266/160 |

*Primary Examiner*—Melvyn Andrews

*Attorney, Agent, or Firm*—R. Hain Swope; David A. Draegert; Salvatore P. Pace

[57] ABSTRACT

Method and apparatus for performing a metallurgical process in which a carbonaceous material is converted to a reducing gas and a metal is melted in a main reactor, particulate coal is partially oxidized in a secondary reactor to form a particulate char and a calorific gas under conditions which minimize the formation of carbon monoxide, and at least part of the char and some of the calorific gas are introduced into the main reactor.

30 Claims, 1 Drawing Sheet

METALLURGICAL PROCESS

RELATED APPLICATION

This is a continuation-in-part application of U.S. Ser. No. 08/214,900 filed on Mar. 17, 1994, now abandoned.

TECHNICAL FIELD

The present invention relates to metallurgical processes and apparatus in which a carbonaceous material is converted to a reducing gas and a metal is melted in a main reactor, particulate coal is partially oxidized in a secondary reactor to form a particulate char and a calorific gas, most of the particulate char and a small portion of the calorific gas are sent to the main reactor with up to all of the char being used to form the carbonaceous material.

BACKGROUND OF THE PRIOR ART

Most of the world's iron is made in blast furnaces. A blast furnace is an example of a vertical shaft furnace. The primary function of a blast furnace is to reduce iron ore to iron. A charge comprising iron ore, coke and fluxing ingredients is introduced into the top of the blast furnace to form a bed. A blast of pre-heated air is used to burn the coke to form carbon monoxide. The carbon monoxide reduces the iron ore to iron.

The heat liberated by the combustion of the coke is used to melt the iron, Iron and slag are removed as molten products at the bottom of the furnace. The air blast is introduced near the bottom of the furnace so as to form a high temperature oxidation region beneath the bed. The blast may be enriched in oxygen in order to facilitate the production of high temperatures typically in the range of 2100° to 2200° C., in the furnace raceway.

Such processes are disadvantageous because they consume large amounts of coke. One way of achieving a reduction in coke consumption is to inject particulate coal into the furnace with the air blast. An apparatus for performing this step is described in U.S. Pat. No. 4,887,800. One disadvantage associated with the injection of coal into the furnace is that, relative to coke, coal requires a greater proportion of oxygen for combustion and creates a greater thermal load on the blast furnace. Accordingly, the greater the amount of coal injected into the blast furnace, the larger the amount of oxygen in the blast air needed to maintain the temperature of the raceway in the chosen range of 2100° to 2200° C. This disadvantage has restricted the use of coal in the manufacture of iron in a blast furnace and other metallurgical processes.

Various processes are known for pretreating coal so as to improve its combustion. For example, U.S. Pat. No. 3,250,016 discloses a method of preparing coal for injection into the tuyeres of a blast furnace. The method comprises feeding coal fines and top gas from the blast furnace to a fluidized bed drier, discharging the dried coal from the drier, screen-sizing the dried coal to separate undersized particles having a maximum size of about 3.2 mm that are suitable for injection, pulverizing the oversized coal particles for further screen-sizing, and cleaning, compressing, and drying the off-gas from the drier. This method involves drying the coal at relatively low temperatures in a reducing atmosphere. European Patent Application No. 467,375 discloses using a non-oxidizing atmosphere, for example, nitrogen to dry the coal. Neither U.S. Pat. No. 3,250,016 nor European Patent Application No. 467,375 discloses the step of driving off volatile hydrocarbons from the coal in a pretreatment region. Accordingly, neither of these references provide a means of overcoming the above mentioned disadvantage.

SUMMARY OF THE INVENTION

In its broadest aspect the present invention provides a metallurgical process comprising convening a carbonaceous material to a reducing gas in the presence of pure oxygen or oxygen-enriched air and melting a metal in a main reactor, partially oxidizing particulate coal in a secondary reactor separate from said main reactor to form a particulate char and a calorific gas, and introducing at an elevated temperature at least pan of the char and up to some of the calorific gas into the main reactor, the part of the char introduced into the main reactor forming up to all of the carbonaceous material. In accordance with the present invention the secondary reactor is operated so as to maximize the production of carbon dioxide and minimize the production of carbon monoxide so as to minimize fuel consumption.

As used herein the term "calorific gas" shall mean a gas produced in the secondary reactor having a $CO_2/CO$ molar ratio exceeding 0.25. The calorific gas preferably has a $CO_2/CO$ molar ratio of greater than 1.0. The term "reducing gas" shall mean a gas used for the conversion of a metal ore to a metal in which the $CO_2/CO$ molar ratio is less than about 0.25, preferably less than about 0.05.

The present invention also provides apparatus for carrying out the process comprising a main reactor for converting a carbonaceous material to a reducing gas and for melting the metal, the main reactor comprising at least one inlet for introducing pure oxygen or oxygen-enriched air into the main reactor; a secondary reactor separate from said main reactor comprising means for partially oxidizing particulate coal to form a particulate char and a calorific gas, an inlet for said coal and an inlet for oxidizing gas, and means for introducing at an elevated temperature at least part of the char and up to some of the calorific gas into the main reactor to provide up to all of the carbonaceous material. The secondary reactor is also provided with the means for maximizing the production of carbon dioxide relative to the amount of carbon monoxide produced.

BRIEF DESCRIPTION OF THE DRAWINGS

The following drawings are for illustrative purposes only and are not intended to limit the invention as encompassed by the claims forming part of the application.

DETAILED DESCRIPTION OF THE INVENTION

Figure 1:
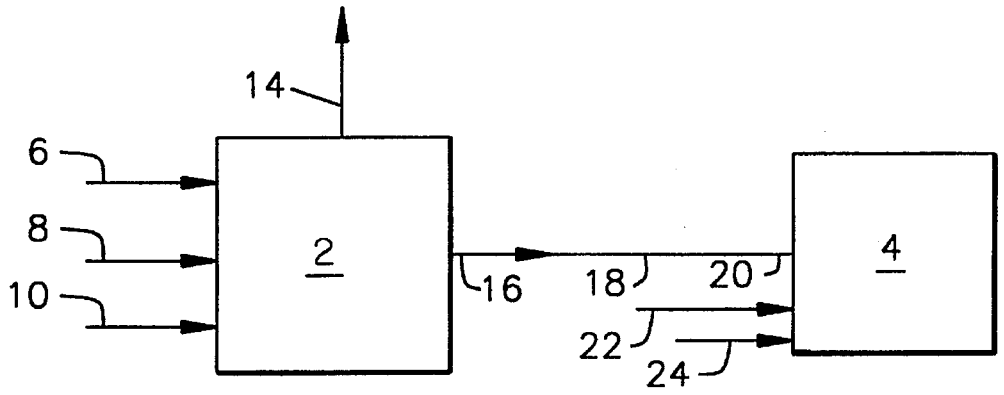
FIG. 1 is a schematic flow diagram illustrating an embodiment of the present invention.

The present invention is directed to a metallurgical process and apparatus in which particulate coal is treated in a manner which improves the efficiency of producing metals from ore and a reducing gas especially in a blast furnace including minimizing fuel consumption.

In a preferred form of the invention the part of the char introduced into the main reactor is fed therein continuously by any conventional method. The temperature at which this main reactor char feed is introduced into the main reactor is preferably substantially the same as the temperature at which it is formed in the secondary reactor, but in any event is desirably at least 150° C.

The char is preferably separated upstream of the main reactor into a first fraction of relatively fine particles and a second fraction of relatively coarse particles. Part of preferably all of the second fraction is fed to the main reactor.

The partial oxidation of the particulate coal is preferably performed in a back-mixed reactor such as a spouted bed reactor or a fluidized bed reactor. The fluidized bed may have a uniform gas velocity therethrough. Alternatively, the fluidized bed or spouted bed may be provided with one or more recirculation regions.

The partial oxidation of the particulate coal is carried out under conditions which maximize the production of carbon dioxide and minimize the production of carbon monoxide. By maximizing the ratio of $CO_2$:CO, the fuel necessary to preheat the coal feed and therefore the energy required to conduct the metallurgical process is reduced over conventional processes.

In particular, the heat of formation for carbon dioxide is −94 kcal/gram mole of carbon. The heat of formation for carbon monoxide is −26.4 kcal/gram mole of carbon. Therefore, the consumption of carbon for preheating the coal feed by the oxidation of carbon to carbon dioxide is about only ¼ of the carbon consumed as compared with carbon monoxide. Initially oxygen reacts with the carbon to produce carbon dioxide via the reaction (I):

$$C+O_2 \rightarrow CO_2 \quad \text{(I)}$$

The carbon dioxide reacts with additional carbon via the reaction (II):

$$CO_2+C \rightarrow 2CO \quad \text{(II)}$$

which consumes more carbon and less heat.

In accordance with the present invention, it is desirable to minimize the conversion of carbon dioxide to carbon monoxide as expressed by reaction (II). In general the conversion of carbon dioxide to carbon monoxide can be minimized by controlling the process temperature and/or the residence time of the reactive gases (i.e. oxygen and carbon dioxide) within the secondary reaction zone.

In particular, the rate of reaction (II) increases very rapidly as the temperature of the secondary reaction zone increases, it is therefore desirable to avoid high temperatures in the secondary reaction zone. Therefore, the secondary reaction zone should be maintained at a temperature of from about 750° to 1100° C., preferably from about 800° to 1000° C.

At temperatures within the above-mentioned range, the rate of reaction (I) is much greater than the rate of reaction (II). Thus, in accordance with the present invention, the residence time of the reactives, if kept short, will minimize the formation of carbon monoxide via reaction (II). Thus, it is desirable to make the rate of removal of the $CO_2$-rich calorific gas rapid relative the rate at which carbon dioxide is converted to carbon monoxide. For example, the rate at which the $CO_2$-rich calorific gas is removed in a fluidized bed is determined by the particle settling velocity, which is approximately proportional to the square root of the particle diameter. The coal char surface area for the conversion reaction of carbon dioxide to carbon monoxide is inversely proportional to the particle diameter. Thus increasing the particle size results in an increase in the rate at which the $CO_2$-rich calorific gas is removed and a decrease in the rate that the $CO_2$-rich gas reacts with carbon and therefore provides for a decrease in the conversion of carbon dioxide to carbon monoxide. Thus, it is desirable to maintain the particle size of the coal in the range of from about 0.1 to 50 mm, preferably from about 1 to 20 mm.

Another method of minimizing reaction (II) is to limit the residence time of the particulate coal that is oxidized in the secondary reaction zone. In particular, the residence time of particulate coal in the secondary reaction zone is limited to that which is needed to generate heat to the desired temperature range (i,e. from about 750° to 1100° C.), typically from about 10 to 500 seconds, preferably 50 to 150 seconds. The residence time of the particulate coal within the secondary reaction zone can be controlled for example by changing the height of the fluidized bed while maintaining a constant coal feed rate.

Minimization of gas residence time provides the most efficient way of minimizing the undesired conversion of carbon dioxide to carbon monoxide. In a standard fluidized bed reactor, a uniform gas velocity is used to expand or fluidize the bed of particulate coal. The gas velocity is primarily determined by the particle size of the coal and to a lesser extent the density of the coal and the gas phases. Large particle sizes for the coal tends to result in a shorter gas residence time.

The residence time of oxygen and carbon dioxide can also be minimized by increasing the velocity of the gases in localized areas. In this embodiment, a spouted bed reactor can be employed and the same particle size range for the particulate coal (i.e. 0.1 to 50 mm) should be used. In a preferred form of the invention, the velocity of the gases should be well above the particle settling rate. An entrained solids reactor using a cyclone for rapidly separating the gas from the solids is preferred in this embodiment.

In the general operation of the present process, it will typically be difficult to avoid passing a portion of the calorific gas into the main reactor with part of the char. It is desirable however to minimize the proportion of the calorific gas that is introduced into the main reactor so as to minimize the rate of consumption of oxygen in the main reactor and to avoid having to preheat the calorific gas to the operating temperature of the main reactor. If the partial oxidation of the particulate coal is accomplished in a fluidized bed, the first fraction of char particles may be carried out of the fluidized bed entrained in the calorific gas formed as a result of the partial oxidation reaction. The second fraction may be withdrawn from the fluidized bed, for example, through one or more outlets at the side or bottom of the fluidized bed. Some of the calorific gas will be withdrawn with the second fraction, but the major proportion of the calorific gas will pass vertically upwards out of the fluidized bed.

As previously indicated, the particulate coal may be partially oxidized in a temperature range of from about 750° to 1100° C. The partial oxidation temperature is preferably in the range of from about 800° to 1000° C. In general, when operating the method and apparatus according to the present invention to form a hot char for introduction into an iron-producing blast furnace, the higher the temperature at which the char is formed, the less the rate at which coke is fed into the top of the furnace as part of the furnace charge or burden. By conducting the partial oxidation reaction in the preferred temperature range, there is a considerable reduction in the rate of consumption of coke by the furnace without the need for special construction materials for the reactor in which the partial oxidation reaction takes place. The overall partial oxidation reaction is exothermic, and the partial oxidation reactions are self sustaining once an appropriate temperature has been established in the reactor.

The oxidizing gas employed in the partial oxidation reaction is preferably ambient air. If desired, the air may be preheated or enriched in oxygen. In general, however, neither oxygen enrichment nor preheating is required in order to obtain a desired partial oxidation temperature. Depending on the proportion of volatiles in the coal, cooling of the partial oxidation reaction may be desirable in order to maintain a desired temperature. Such cooling may be obtained by injecting nitrogen, water or steam into a bed in which the char is formed. However, it is preferred to feed the devolatilized coal directly to the metallurgical process without cooling to maximize the thermal efficiency of the overall process.

There are no special requirements for coal grinding machinery in order to prepare a particulate coal for use in the method or apparatus according to the present invention. Typically, the average particle size of the particulate coal in accordance with the present invention is in the range of from about 0.1 to 50 mm and is readily achieved with conventional coal grinding machinery.

The calorific gas typically has a calorific value in the range of 3 to 5 $MJ/m^3$. This is a slightly higher calorific value than that of a typical blast furnace gas. In a preferred form of the invention, the calorific gas it typically produced at a constant calorific value. The calorific gas is therefore a valuable by-product and may be used in other processes on the site of the main and secondary reactors. If desired, the first fraction of char may be recovered from the calorific gas in which it is entrained. The recovery of the first fraction may be carried out by any convenient gas-solid separation method, for example, by filtration in an aqueous scrubber or in a cyclone. Water or steam may, if needed, be added to the calorific gas in order to reduce its temperature to a level suitable for introduction into the cyclone.

The calorific gas separated with the first fraction may be burned and the resulting combustion product used to generate steam. It is also possible to burn the calorific gas in a combustion chamber forming part of a gas turbine. If desired, heat may be recovered from the calorific gas upstream of such combustion, for example, by indirect heat exchange with a stream of pressurized nitrogen. Downstream of the heat exchanger, the stream of pressurized nitrogen may be expanded in a turbine with the performance of external work. For example, the expansion may be performed in a turbine which is coupled to an alternator and as a result electrical power may be generated.

The method according to the present invention is particularly applicable to the production of a metal, for example iron, from its ore by reaction with the reducing gas. The main reactor may therefore comprise a blast furnace. The method according to the invention then comprises establishing a bed including coke and iron ore in the shaft of the furnace, and supplying a blast of hot air to an oxidation region below and contiguous to the bed, wherein said part of the char and said oxygen or oxygen-enriched air are both introduced into the oxidation region while minimizing the formation of carbon monoxide as previously described. In the production of iron in a blast furnace, particles of iron ore may be introduced into the furnace through tuyeres. Typically, up to 10% of the total iron ore feed may be introduced through the tuyeres.

The method according to the present invention is not limited in application to the manufacture of iron in a blast furnace. It is also applicable to the manufacture of iron by the Corex process. In the Corex process, the main reactor comprises two separate stages. In a first state iron is produced by reduction of iron ore with a reducing gas. In a second stage the iron is melted and coal is gasified to form the reducing gas used in the first stage. In the application of the method according to the invention the said part of the char and the oxygen-enriched air or pure oxygen are introduced into the second stage. Accordingly, coal consumption may be reduced or the molten iron produced at a higher temperature than otherwise possible.

The main reactor may alternatively be an electric arc or other melting furnace. The oxygen or oxygen-enriched air is introduced beneath the surface of a melt that is created in the furnace. The said part of the char may be introduced into the furnace as part of a charge including the metal to be melted. If desired at least part of the metal may be formed in situ by the reduction of an ore of the metal.

Referring to FIG. 1 of the drawings, the illustrated apparatus of the present invention includes a secondary reactor 2 and a main reactor 4. Coarsely ground coal having an average particle size of from about 0.1 to 50 mm is converted in the secondary reactor 2 to a particulate char and a calorific gas mixture containing carbon monoxide and hydrogen as combustible constituents. The particulate coal is fed into the secondary reactor 2 through an inlet 6. Coal may be conveyed to the inlet 6 by any conventional means, such as pneumatic transfer in a neutral or reducing atmosphere or even in air. The coal 6 is mixed in the secondary reactor with a flow of air or oxygen-enriched air supplied through an inlet 8. The secondary reactor 2 is maintained at a temperature in the range of from about 750° to 1100° C., and the relative rates of admission to the secondary reactor 2 of the coal and air are selected so that partial oxidation of the coal takes place while minimizing the formation of carbon monoxide.

The air feed to the secondary reactor 2 is typically selected so as to minimize hydrocarbon formation even at the expense of production of a calorific gas having $CO_2/CO$ molar ratio greater than 0.25. A number of different chemical reactions take place including the evolution of volatile hydrocarbons, the oxidation of volatile hydrocarbons to carbon dioxide and water vapor, the reduction of carbon dioxide by carbon to carbon monoxide, and the reaction of water vapor with carbon to form carbon monoxide and hydrogen. In addition, a reversible reaction between carbon monoxide and water vapor to form carbon dioxide and hydrogen also takes place. These reactions are represented by the following equations:

$$C\ (solid)+O_2 \rightarrow CO_2$$

$$Cn\ Hy\ (solid) \rightarrow Cn\ Hy\ (gas)$$

$$Cn\ Hy\ (gas)+(4n+1)O_2 \rightarrow nCO_2+yH_2O$$

$$CO_2+C \rightarrow 2CO$$

$$C+H_2O \rightarrow CO+H_2$$

$$CO+H_2O \rightarrow CO_2+H_2$$

The reactions involving elemental carbon proceed much more slowly than the other reactions. The predominant reactions are the evolution of hydrocarbons and the oxidation of the hydrocarbons to produce hydrogen, carbon monoxide and carbon dioxide. Small amounts of various gaseous impurities such as hydrogen sulfide and ammonia may also be formed.

In accordance with the invention the conversion of carbon dioxide to carbon monoxide is minimized in part by reducing the residence time of the oxygen-containing gas (e.g. air)

and carbon dioxide in the secondary reaction zone. This is done by removing the carbon dioxide before it has an opportunity to react with the particulate coal and/or by controlling the secondary reaction zone temperature such as by controlling the amount, the particle size, and/or residence time of the particulate coal in the secondary reaction zone.

Depending on the composition of the coal, the temperature of the reactor 2 and the relative feeding rates of the reactants into the reactor 2, a calorific gas of varying composition, typically having a calorific value in the range of 3 to 5 $MJ/m^3$ is produced. A typical though not critical composition of the calorific gas is as follows:

| Specie | Vol % |
|---|---|
| $CO_2$ | 14.5 |
| CO | 7.0 |
| $H_2$ | 9.5 |
| $CH_4$ | 3.7 |
| $C_2H_4$ | 0.4 |
| TOTAL | 35.0% |
| $MJ/m^3$ | 3.6 |

One advantage of the present invention is the production of a calorific gas having a calorific value greater than the calorific value of the blast furnace gas. Moreover, it is generally possible to change the operating conditions in the secondary reactor 2 in response to changes in the operating conditions of the main reactor 4, while still producing calorific gas at a desired rate and at a desired calorific value. Accordingly, problems that might arise in operating downstream apparatus to burn the gas as a result of fluctuating calorific value are minimized.

If desired, the air fed to the secondary reactor 2 through the inlet 8 may be preheated although this is generally not necessary. Preferred reaction temperatures can generally be maintained without preheating owing to the net exothermic nature of the chemical reactions involved. Alternatively, it is possible to enrich the air with oxygen by introducing commercially pure oxygen or oxygen-enriched air into the secondary reactor 2 through an inlet 10 or by premixing oxygen with the air upstream of the inlet 8. However, for the reasons mentioned above, this procedure is not a preferred means of carrying out the present invention. It is also possible to add water or steam as a reactant from an external source through the inlet 6. Alternatively, the water or steam may be premixed with the air at or upstream of the inlet 8. The water or steam also functions as a temperature moderator. The controlled addition of water or steam can be used to regulate the temperature in the reactor 2.

In a preferred form of the invention, the resulting char can be separated into a first fraction of relatively fine particles and a second fraction of relatively coarse particles in the secondary reactor 2 itself rather than in a separate vessel. Accordingly, the partial oxidation of the incoming coal particles is preferably performed in a bed and gaseous combustion products flowing out of the bed elutriate the finest particles of resulting char. Such particles may typically have sizes in the range of from about 0.1 mm to 400 mesh. A residual fraction of relatively coarse particles is thus left in the bed and may be withdrawn therefrom intermittently or, preferably, continuously.

The bed of particulate char formed in the secondary reactor 2 is preferably a fluidized bed. Within the secondary reactor 2 the coal char is preheated to a temperature sufficient to burn the coal volatiles to produce the $CO_2$-rich calorific gas. The fluidized bed preferably has an expansion of from about 10 to 30% of the unfluidized bed volume, and may be of the spouted bed or crater bed type or otherwise provide for recirculation of gas and particles within the bed.

A first stream of calorific gas is withdrawn from the top of the secondary reactor 2 through an outlet 14. This stream has entrained therein the first fraction of the particles of coal char. A second stream of calorific gas is withdrawn from the side of the secondary reactor 2 through an outlet 16 along with the second fraction of coal char. Typically, the first fraction of coal char constitutes less than about 10% by weight of the total weight of the first and second fractions. This is because only fine particles of char are carried out of the reactor 2 with the first stream of calorific gas. The rate of flow of the first stream of calorific gas out of the secondary reactor 2 is arranged to be substantially in excess of that of the second stream of calorific gas.

The first stream of calorific gas may be put to any one of a number of different uses. For example, the first stream may be eventually burned and the resulting combustion products used to raise steam. Further, sensible heat may be recovered form the first stream of calorific gas in a heat exchanger. In addition, the first fraction of char particles may be disengaged from the first stream of calorific gas in a cyclone (not shown). Still further, the char particles may be separated by filtration or in an aqueous scrubber. In another embodiment, the first stream of calorific gas may be treated before combustion to remove oxides of nitrogen and sulfur therefrom and to dry the gas. The calorific gas is typically produced over a period of time to a constant calorific value.

In commencing the operation of the process of the present invention, the reactor 2 may be preheated to a desired operating temperature using one or more burners (not shown). Once the desired operating temperature has been achieved operation of the burners is stopped.

It is desirable to withdraw the second fraction of particulate char continuously from the secondary reactor 2 to enable the second fraction to be introduced continuously into the main reactor 4 at substantially the same temperature as that at which it leaves the secondary reactor 2. The main reactor 4 may for example be provided by the gasifier/melter of a Corex plant, a metal melting furnace, for example, an electric arc furnace, or a metal ore smelting furnace. The method according to the invention is however particularly suited for operation of a blast furnace.

The main reactor 4 typically operates at a substantially higher temperature than the reactor 2. in the example of a blast furnace used to make iron, a maximum temperature in the furnace is in the range of from about 2100° to 2200° C. Accordingly, the second fraction of particulate coal char is preferably fed directly through an inlet or inlets 20 to the reactor 4 via a conduit 18 without any prolonged dwell time to avoid the loss of sensible heat. Since the second fraction of coal char is produced in the reactor 2 at an elevated temperature, the second fraction of char is conveyed to the inlet or inlets 20 in a reducing or neutral gaseous medium so as to minimize the hazard of fire or explosion. The second stream of calorific gas withdrawn from the reactor 2 through the outlet 16 may be used as the carrier gas. If desired, the flow of the second fraction from the secondary reactor 2 to the main reactor 4 may be assisted by gravity.

In operation of the main reactor 4, such as a blast furnace, a bed (not shown) comprising coke and typically iron ore is maintained therein. The second fraction of particulate char particles enters the main reactor 4 in essentially a gaseous oxidizing or flame region below the bed. The char particles are therefore rapidly burned to form carbon dioxide. Some ash is also formed. The carbon dioxide rapidly reacts with carbon to form carbon monoxide which, in the example of the manufacture of iron, reduces iron ore to metallic iron in accordance with the following equations:

$$C+O_2 \rightarrow CO_2$$

$$CO_2+C \rightarrow 2CO$$

$$Fe_2O_3+3CO \rightarrow 2Fe+3CO_2$$

As will be well understood by those skilled in the art of blast furnace operations, a number of other chemical reactions take place in the blast furnace. In essence, however, the products of the blast furnace are molten iron and a slag which are withdrawn from the bottom of the furnace and a reducing gas which is withdrawn from the top of the furnace.

In order to obtain the necessary high temperature combustion conditions within the main reactor 4, a blast of air is provided to the reactor 4 through an inlet 22. The air is preferably preheated to a temperature in the range of from about 1000° to 1200° C. In addition, a stream of pure oxygen or oxygen-enriched air (preferably at least 90% pure) is injected into the reactor 4 through an inlet or inlets 24. Typically, there may be a plurality of tuyeres (not shown) associated with the reactor 4, each tuyere having separate passages corresponding to inlets 20, 22 and 24, respectively. Alternatively, the oxygen may be premixed with the air. Typically, the relative rates of the passage of air and oxygen into the reactor 3 are such that the concentration of oxygen in the air is raised to a value in the range of from about 25 to 30% by volume.

Since the secondary reactor 2 preheats the particulate coal and reduces the volatile content of the coal feed, the demand for oxygen in the main reactor 4 for total combustion is reduced. The level of oxygen is less than that required if the total requirement for carbon is met entirely by the supply of coal. Further, the thermal load on the main reactor 4 is reduced mainly as a result of the devolatilization process in the secondary reactor 2. The thermal load is also reduced because the char is supplied to the main reactor 4 at an elevated temperature. A further advantage obtained herein is that evolution of volatile hydrocarbons takes place in the secondary reactor 2 and not in the main reactor 4. By excluding most of the volatile hydrocarbons from the main reactor 4, the deposition of soot as a result of the decomposition of such volatile hydrocarbons is minimized. Soot reduces the permeability of the charge in a blast furnace and thereby impairs efficient operation. Further, separation of the finest particles of char upstream of the main reactor 4 prevents the entry of these particles into the reactor 4.

Figure 2:
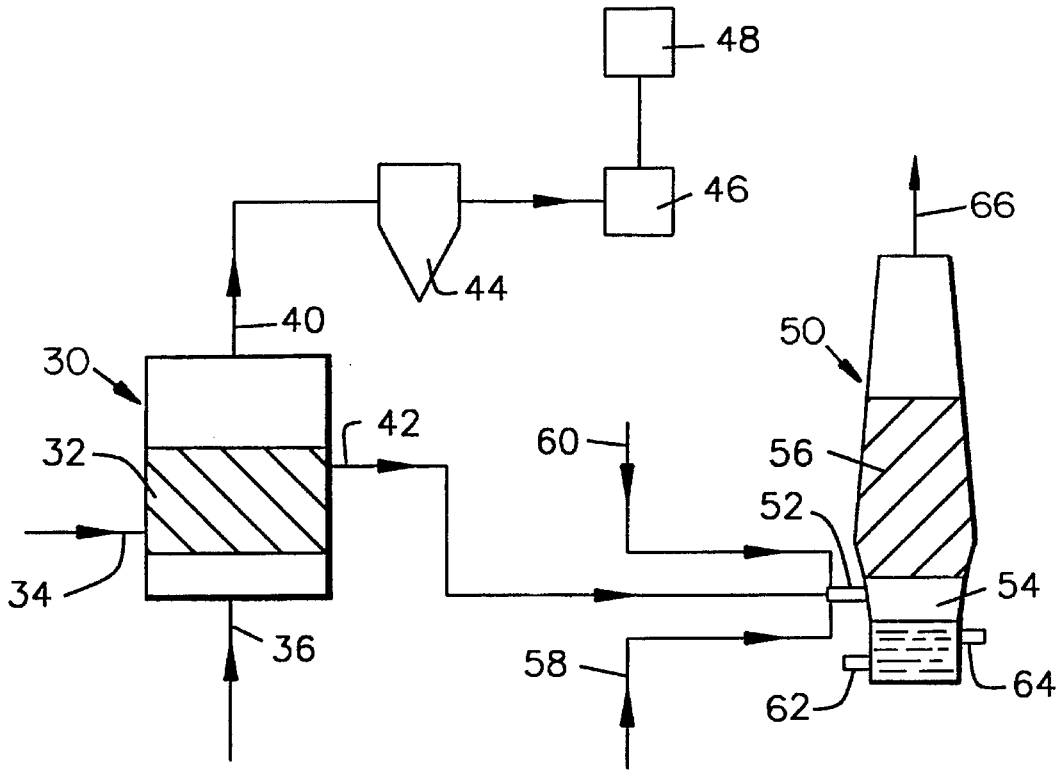
FIG. 2 is a schematic diagram illustrating a blast furnace and ancillary equipment operable in accordance with the present invention.

Referring now to FIG. 2, there is shown a fluidized bed reactor and the products obtained therefrom. More specifically, coal is fed through an inlet 34 into a fluidized bed 32 having a dense phase is maintained at a temperature typically from about 750° to 1100° C. The coal having a particle size of from about 0.1 to 50 mm, preferably from about 1 to 20 mm is typically fed into the reactor 30 as a suspension in a carrier gas such as nitrogen gas or air and maintained therein for a period of from about 10 to 500 seconds, preferably from about 50 to 150 seconds. For example, about 1 part by weight of nitrogen is used per about 23.3 parts by weight of coal (or in volumetric terms 3 parts of nitrogen to 1 part of coal). The nitrogen carrier gas it typically employed at a pressure of from about 3 to 6 bar absolute.

The bed 32 is fluidized by a stream of air introduced into the bottom of the reactor 30 through an inlet 36. The pressure of the air supply is typically from about 3 to 6 bar absolute. The mass ratio of air introduced into the reactor 30 to coal is from about 1 to 1.4. Under such operating conditions, it is desirable to introduce water into the reactor 30 so as to maintain the temperature therein at the chosen temperature. Accordingly, water or steam may be added to the carrier nitrogen gas. If desired, the rate of addition of the water may be controlled by a temperature sensor (not shown) which measures the temperature of the bed 32. The net effect of the reaction which occur in the bed 32 is that the coal is devolatilized and converted to a char while at the same time a calorific gas is formed comprising principally nitrogen, hydrogen, carbon monoxide, carbon dioxide and water vapor.

Typically, the coal undergoes a loss of from about 5 to 25% of its weight by virtue of devolatilization in the reactor 30 depending on the composition of the coal, the secondary reactor temperature, and the presence of secondary reactor cooling. The conversion of carbon dioxide to carbon monoxide is minimized by limiting the secondary reactor temperature to the range of from about 750° to 1100° C., using coal having a particle size of from about 0.1 to 50 mm and limiting residence of the coal char to that necessary to reach the desired temperature. The calorific gas typically has a calorific value of about 3.6 $MJ/m^3$. The presence of any unburned hydrocarbons can substantially increase the calorific value of the calorific gas. However, the presence of hydrocarbons is generally undesirable. Most of the resulting calorific gas passes through the top of the fluidized bed 32 and out of the reactor 30 through an outlet 40. The exiting calorific gas flow constitutes a first stream of calorific gas.

The first gas stream has entrained therein a first fraction comprising fine particles of coal char which are elutriated from the bed 32. A second fraction of coal char is withdrawn from the bed 32 through an outlet 42, which may be above, below or at the same level as that of the inlet 34. Some of the calorific gas formed in the bed 32 flows through the outlet 42 as a second stream with the second fraction of coal char. Typically, about 99% by weight of the coal char formed in the reactor 30 is taken as the second fraction and about 1% by weight as the first fraction. At least 75% of the gaseous products of combustion flow out of the reactor 30 through the outlet 40.

The first stream of calorific gas flows through the outlet to an optional cyclone 44 where the entrained particles of char are disengaged therefrom. The resulting fine carbon product may, for example, be burned to generate heat. The first calorific gas stream from which the particles of carbon have been disengaged flows to a scrubbing unit 46 to remove impurities such as oxides of sulfur and nitrogen. The unit 46 may also include a condenser which frees most of the water vapor contained in the gas stream. The resulting cleaned gas may then be sent to a boiler 48 to raise steam. Alternatively, the cleaned gas may be passed to the combustion chamber of a gas turbine (not shown) and the resulting combustion products expanded to generate, for example, electrical power.

The second fraction of relatively coarse particles of coal char withdrawn from the reactor 30 through the outlet 42 is conveyed to the tuyeres 52 of a blast furnace 50 (only one such tuyere 52 is shown in FIG. 2). The coal char is thus injected through the tuyeres 52 into a raceway 54 of the furnace 50. The raceway 54 is contiguous to a bed or burden 56 comprising coke, iron oxide, and limestone or other fluxing ingredients.

The tuyeres 52 also receive a stream of air preheated to a temperature of 1100° C. from a pipeline 58 and a stream of oxygen containing up to 10% by volume of gaseous impurities from a pipeline 60. The particles of char are kept separate from the oxygen and preheated air until they enter the raceway 54 of the furnace 50. Intense combustion takes place in the raceway 54 and a temperature of about 2160° C. is typically obtained, In such an environment a major proportion of the particles of char are converted to ash and gaseous combustion products.

The primary reactions which occur in the raceway 54 and the burden 56 are as follows:

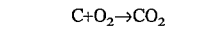

$$C+O_2 \rightarrow CO_2$$

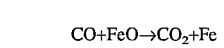

$$C+CO_2 \rightarrow 2CO$$

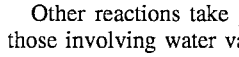

$$CO+FeO \rightarrow CO_2+Fe$$

Other reactions take place in the raceway 54 including those involving water vapor and hydrogen.

The operation of the blast furnace 50 is generally conventional. Iron formed as a result of the reduction of iron ore by carbon monoxide is melted as a result of the intense heat created by the combustion of carbon in the raceway 54. The resulting molten iron may be tapped off from the bottom of the furnace through an outlet 62. The molten slag collects on the surface of the molten iron and may be tapped off through an outlet 64. Since the bottom of the burden 56 is continuously consumed in the intense combustion region created in the raceway 54, fresh charge is periodically loaded through the top of the shaft of the furnace 50. In addition, the blast furnace gas flows out of the top 66 of the furnace 50 and may be collected.

Although the operation of the blast furnace 50 is generally conventional as described above, certain changes are made possible by the injection of the particles of char into the furnace 50 through the tuyeres 52. In particular, the rate of coke consumption is reduced. For example, a blast furnace which is normally fed with coke at a rate of about 480 kg per tonne and coal at a rate of about 60 kg per tonne of hot metal produced may, for example, have the coke feed rate reduced to about 360 kg per tonne of hot metal. This specific reduction in the coke feed rate is obtained when char is injected into the furnace 50 through the tuyeres 52 at a temperature of about 750° C. and oxygen is introduced into the furnace 50 at a rate of about 50 kg of oxygen per tonne of hot metal (such oxygen introduction rate amounting to about 8% of the total flow of oxygen molecules into the furnace through the tuyeres). The calorific value of the blast furnace gas produced under these conditions is about 2.5 $MJ/m^3$.

The calorific value of the blast furnace gas may be enhanced by injecting iron ore into the raceway 54 of the furnace 50 through the tuyeres 52. Typically, up to 5% of the total iron ore feed may be injected through the tuyeres. With a char feed temperature of about 750° C. and a rate of introducing oxygen to enrich the air blast equivalent to about 100 kg of oxygen per tonne of hot metal, it is possible to increase the calorific value of the blast furnace gas to nearly 3 $MJ/m^3$.

From the foregoing, it will be appreciated that, although specific embodiments of the invention have been described herein for purposes of illustration, various modifications may be made without deviating from the spirit and scope of the invention.

EXAMPLE 1

A metallurgical apparatus as shown generally in FIG. 2 was fed with coal having an average particle size of 3 mm to a secondary reactor operating at a temperature of 750° C. The particulate coal was maintained in the secondary reactor for about 150 seconds.

The secondary reactor off-gas $CO_2/CO$ ratio was 2. The residence time of the $CO_2$ was controlled so that the residence time of $CO_2$ in the secondary reactor averaged less than 3 seconds.

The % conversion of the coal to char product and the composition thereof was determined and the results are shown in Table 1.

TABLE 1

| EXAMPLE | CHAR PRODUCT AS WEIGHT % OF COAL FEED | COMPOSITION | | | | | |
|---|---|---|---|---|---|---|---|
| | | ASH | C | H | O | N | S |
| 1 | 92.0% | 9.96 | 82.30 | 3.9 | 2.57 | 0.89 | 0.38 |

I claim:

1. A metallurgical process comprising:

(a) converting a carbonaceous material to a reducing gas in the presence of oxygen or oxygen-enriched air in a main reactor;

(b) melting a metal in the main reactor;

(c) partially oxidizing particulate coal in a secondary reactor separate from said main reactor under conditions which form a particulate char and a calorific gas having a $CO_2/CO$ ratio of at least 0.25; and (d) introducing at an elevated temperature at least part of the char and up to some of the calorific gas produced in the secondary reactor into the main reactor, the part of the char introduced into the main reactor forming up to all of said carbonaceous material.

2. The process of claim 1 comprising conducting the partial oxidation reaction at a temperature of from about 750° to 1100° C.

3. The process of claim 1 wherein step (c) comprises contacting the particulate coal with oxygen or oxygen-enriched air.

4. The process of claim 1 wherein step (c) comprises minimizing the residence time of carbon dioxide within the secondary reaction zone to minimize the conversion of carbon dioxide to carbon monoxide.

5. The process of claim 1 wherein step (c) comprises contacting particulate coal having a particle size of from about 0.1 to 50 mm with oxygen or oxygen-enriched air.

6. The process of claim 5 wherein the particle size is from about 1 to 20 mm.

7. The process of claim 1 wherein step (c) comprises controlling the residence time of the particulate coal within the secondary reactor.

8. The process of claim 7 wherein the residence time of the particulate coal in the secondary reactor is from about 10 to 500 seconds.

9. The process of claim 8 wherein the residence time of the particulate coal in the secondary reactor is from about 50 to 150 seconds.

10. The process of claim 1, wherein the said at least part of the char is introduced continuously into the main reactor.

11. The process of claim 1, wherein temperature of said at least part of the char is at least 150° C.

12. The process of claim 1 comprising separating the char upstream of the main reactor into a first fraction comprising relatively fine particles and a second fraction comprising relatively coarse particles, and feeding at least part of the second fraction to the main reactor.

13. The process of claim 12 in which all of the second fraction is fed to the main reactor.

14. The process of claim 12 in which step of partially oxidizing the particulate coal in the secondary reactor is performed in a fluidized bed.

15. The process of claim 14 comprising removing the first fraction of char from the fluidized bed in a major stream of said calorific gas and removing the second fraction of char in a minor stream of said calorific gas.

16. The process of claim 1 wherein the calorific gas has a calorific value in the range of from 3 to 5 $MJ/m^3$.

17. The process of claim 1 comprising partially oxidizing the particulate coal in a fluidized bed, said fluidized bed having an expanded volume of from 10 to 30% greater than an unexpanded volume of the fluidized bed.

18. The method of claim 17 further comprising recirculating gases produced in the fluidized bed.

19. The process of claim 2 wherein the temperature of the partial oxidation reaction is from about 800° to 1000° C.

20. The process of claim 1 comprising conducting the partial oxidation reaction of particulate coal in the presence of air.

21. The process of claim 20 further comprising preheating the air or enriching the air with oxygen.

22. The process of claim 1 comprising conducting the partial oxidation reaction of particulate coal in the presence of at least one of steam, nitrogen and water.

23. The process of claim 1 in which the calorific gas has a constant calorific value.

24. The process of claim 1 further comprising removing up to the balance of the calorific gas.

25. The process of claim 1 comprising melting a metal ore in the presence of a reducing gas to form a corresponding metal.

26. The process of claim 25 wherein the metal ore is iron ore and the corresponding metal is iron.

27. The process of claim 26 wherein the main reactor is a blast furnace, said process further comprising establishing a fluidized bed comprising coke and iron ore in the same furnace, and supplying a blast of hot air to an oxidation region below and contiguous to the fluidized bed, and introducing said part of the char and oxygen or oxygen-enriched air into the oxidation region.

28. The process of claim 27 in which the iron ore is in particulate form, said process further comprising injecting the particulate iron ore into the oxidation region.

29. The process of claim 1 wherein the main reactor is a gasifier-melter.

30. The process of claim 1 wherein the main reactor is a metal melting or smelting furnace.

* * * * *